US005779950A

United States Patent [19]

Kang

[11] Patent Number: 5,779,950

[45] Date of Patent: Jul. 14, 1998

[54] METHOD OF MAKING A SYNTHETIC FIBER CONTAINING INFRARED ENERGY POWDER

[76] Inventor: Dong Soon Kang, Keumjung-Ku, Jang-Jun 1 Dong 222-44 Pusan, Rep. of Korea

[21] Appl. No.: 759,076

[22] Filed: Dec. 2, 1996

[51] Int. Cl.[6] ..... D01F 1/10

[52] U.S. Cl. ..... 264/40.4; 264/141; 264/142; 264/164

[58] Field of Search ..... 264/141, 142, 264/164, 40.4

[56] References Cited

U.S. PATENT DOCUMENTS

| | | |
|---|---|---|
| 3,607,343 | 9/1971 | Longe et al. . |
| 3,715,265 | 2/1973 | Allen et al. . |
| 4,377,618 | 3/1983 | Ikeda et al. . |
| 4,686,791 | 8/1987 | Miyata . |
| 4,746,638 | 5/1988 | Hori et al. . |
| 4,886,972 | 12/1989 | Nakai et al. . |
| 4,999,243 | 3/1991 | Maeda . |
| 5,032,376 | 7/1991 | Kladnig . |
| 5,098,700 | 3/1992 | Nakai et al. . |
| 5,106,657 | 4/1992 | Isshiki . |
| 5,145,734 | 9/1992 | Ito et al. . |
| 5,198,329 | 3/1993 | Noguchi et al. . |
| 5,254,380 | 10/1993 | Salyer . |
| 5,258,228 | 11/1993 | Komuro . |
| 5,268,168 | 12/1993 | Katayama et al. . |
| 5,268,178 | 12/1993 | Calhoun et al. . |
| 5,281,662 | 1/1994 | Ito et al. . |
| 5,298,222 | 3/1994 | O'Leary . |
| 5,374,432 | 12/1994 | Fox, Jr. et al. . |
| 5,422,319 | 6/1995 | Stempin et al. . |
| 5,433,718 | 7/1995 | Brinker . |
| 5,455,106 | 10/1995 | Steffier . |
| 5,466,526 | 11/1995 | Magata . |
| 5,480,707 | 1/1996 | Steffier . |
| 5,484,885 | 1/1996 | Pereira et al. . |

*Primary Examiner*—Leo B. Tentoni
*Attorney, Agent, or Firm*—John K. Park; Law Offices of John K. Park & Associates

[57] ABSTRACT

The present invention describes a new and innovative method of making the synthetic fiber containing the infrared energy powder. The present invention generally has three steps. The first step is mixing a quantity of the synthetic material with a quantity of the infrared energy powder to form a mixture of the synthetic material and the infrared energy powder. The second step is adding a quantity of silicon oil into the mixture of the synthetic material and the infrared energy powder to form a blend of ready to draw substance. The third step is drawing one or more strands of synthetic fiber containing the infrared energy powder from the blend of ready to draw substance. It is believed that the innovative use of the silicone oil holds together the infrared energy powder and the synthetic material better then other conventional methods. The silicone oil acts as an epoxy and also as a lubricant. Also an improvement to the invention may be made by adding a quantity of a silver component along with a mixture of the synthetic material and the infrared energy powder. The inclusion of the silver component enables the final fiber product to have the antibiotic effects.

18 Claims, No Drawings

METHOD OF MAKING A SYNTHETIC FIBER CONTAINING INFRARED ENERGY POWDER

BACKGROUND

This invention relates to a new and innovative method of making a synthetic fiber containing infrared energy powder.

One of the benefits of the invention is that the fiber made from the method described in this invention contains higher level of infrared energy powder, thus enabling the fiber to radiate more of the valued infrared energy radiation. One more benefit of this invention is that the tensile strength of the fiber made from the method described in this invention is higher than the fiber produced using other methods when the fiber contains the same amount of infrared energy powder.

The infrared energy radiation in general heats the object directly with radiation heat and the infrared energy radiation penetrates into inner part of the object like microwave heating used for a microwave oven without heating excessively the surface of the object. Therefore, the infrared energy radiation has been used mainly for heaters such as a stove, a cooking stove and a kotatsu, namely, a low, covered table with a heat source underneath. The infrared energy radiation has also been utilized in a traditional method of cooking for sweet potatoes baked in pebbles. The potatoes are baked comfortably warm by the infrared energy radiation from the heated pebbles.

The infrared energy radiation has been known as useful for the heaters, however, it has become clear that the infrared energy radiation particularly serves for food maturity, food freshness-keeping, taste improvement, atmosphere ionizing and the like. The mechanism is not fully explained, however, the infrared slight energy is proved to be effective in food and living use besides the industrial use through the experiments conducted by the inventor of the present invention.

Lately, the infrared energy powder has been mixed with the synthetic material to form a fiber that is used to weave clothing material. Such fiber has been used to make a variety of clothes: examples are pantyhose, underwear, and parkas. In addition to that, they are useful for blankets, quilts, and wrapping articles.

One of the problems of the prior art inventions is that the fiber could not contain high level of the infrared energy powder within the fiber. The reason is that, as the content of the infrared energy powder increased within the fiber, the strength of the fiber is weakened such that the actual use of the fiber for the commercial purposes were undermined. Therefore, the fibers that have been produced using prior methods contained relatively a low percentage of the infrared energy powder. Furthermore, none of the prior art has successfully combined the antibacterial effects of silver component, such as elemental silver or a silver salt, with the beneficial effects of infrared energy powder.

For the forgoing reasons, there is a need for a new and innovative method of making the synthetic fiber containing a greater quantity of the infrared energy powder, and making the synthetic fiber which may also combine the effects of antibacterial benefits of silver components along with the benefits of the infrared energy powder.

SUMMARY

The present invention is directed to a new and innovative method of making the synthetic fiber containing the infrared energy powder. The method described in this invention enables the production of the synthetic fiber containing infrared energy powder up to about 10% of the total fiber weight, depending upon the diameter of the fiber itself. As an example, when the diameter of the fiber is about 20 Denier, the fiber made by this invention may contain up to 10% of infrared energy powder of the total weight, compared to about 0.5% contained by the fibers made by the previous conventional methods. The content of the infrared energy powder will vary with the thickness of the fiber as better explained below.

The present invention generally has three steps in making the synthetic fiber containing the infrared energy powder. The first step is using a predetermined quantity of the synthetic material with a predetermined quantity of the infrared energy powder to form a mixture of the synthetic material and the infrared energy powder. In this mixture of the synthetic material and the infrared energy powder, it is recommended that about 95% to about 99% of the mixture by weight is comprised of the synthetic material and about 5% to about 1% of the mixture by weight is comprised of the infrared energy powder.

In fact, the proportion of the infrared energy powder may vary from about 10% to about less than 1% of the mixture by weight depending upon the thickness of the fiber that is drawn at the end of the process. Without limiting the scope of the invention, as examples, the following infrared energy powder contents have been achieved. The infrared energy powder content of about 1% when the thickness of the final fiber is 1.5 Denier, about 2% when the thickness of the final fiber is about 3 Denier, about 3% when the thickness of the final fiber is about 6 Denier, about 5% when the thickness of the final fiber is about 10 Denier, and about 10% when the thickness of the final fiber is about 20 Denier in size. Each of the proportionate percentage is based on the weight. The inventor believes even greater then 10% infrared energy powder content may be achieved at a fiber thickness that is more than 20 Denier.

The second step is adding a predetermined quantity of silicone oil into the mixture of the synthetic material and the infrared energy powder to form a blend of ready to draw substance. The preferred amount of the predetermined quantity of the silicone oil is about 1% of the mixture by weight, wherein the weight of the mixture used to calculate the quantity of the silicone oil is measured before the silicone oil is added to the mixture. It is believed that this innovative use of the silicone oil holds together better the infrared energy powder and the synthetic material compared with other conventional methods.

The third step is drawing one or more strands of the synthetic fiber containing the infrared energy powder from the blend of ready to draw substance.

It is believed that the use of the silicone oil blends the mixture of the infrared energy powder and the synthetic material together and acts as an epoxy to add strength to the final fiber product and also as a lubricant to help the fiber be smooth & uniform when drawn. The inventor believes that the most ideal end product, the final fiber, may be obtained when the method of making the synthetic fiber containing the infrared energy powder comprises the steps of mixing the amount of the synthetic material of about 97% of the mixture by weight and the amount of the infrared energy powder of about 3% of the mixture by weight, and blending in about 1% of the mixture by weight of the silicone oil.

An improvement in the final fiber product may be obtained by using the spherical shaped infrared energy powder. The use of the spherical shape infrared energy powder helps preventing the damages to the equipment which are used to mix and draw the fiber. Some prior art relies on, and sometimes prefers, the use of the needle-shaped, cubicle-shaped, or flat disc shaped infrared energy powder, but their use often results in damaging the interior of the mixer and the equipment; especially around the interfaces, screws, bolts, and nodules.

A new and innovative improvement to the invention as described may be made by adding a quantity of a silver component along with the mixture of the synthetic material and the infrared energy powder. The amount of the silver component may be any amount, but the inventor found about 0.2% by total weight to be the most ideal in providing the best final fiber product without weakening the strength of the fibers. The silver component is added before the silicone oil is mixed into the mixture of the synthetic fiber and the infrared energy powder. The inclusion of the silver component enables the final fiber product to have the antibiotic effects.

Three of the most important aspects of this invention is that the process is quite simple, the final product has a higher tensile strength than that of the conventional fiber containing the infrared energy powder or other ceramics and the final product has a smooth and uniform texture (feel good to the skin). Because of the strength of the fiber, the fibers can be used in a variety of fabrics. Moreover, because the final product from this invention contains much more infrared energy powder than the fibers which are made from prior inventions, the useful infrared slight energy radiation is that much stronger and is maintained throughout the life of the fabric. Furthermore, when the silver component is added to the mixture of the infrared energy powder and the synthetic fiber, the final product then contains antibacterial effect without loosing the integrity of the fiber strength. Therefore, it is believed that the fabric which is fabricated using this invention is great for many purposes including, and not limited to, keeping a person warm in a cold environment without the bulkiness, and fermenting various food in a clean environment. The fabric may also be ideal for a patient to be kept warm in a hospital or a sanitary environment.

These and other features, aspects, and advantages of the present invention will become better understood with regard to the following description, and appended claims.

DESCRIPTION

The present invention is directed to a new and innovative method of making the synthetic fiber containing the infrared energy powder. The method described in this invention enables the production of the synthetic fiber containing infrared energy powder up to about 10% of the total fiber weight, depending upon the diameter of the fiber itself. As an example, when the diameter of the fiber is about 20 Denier, the fiber made by this invention may contain up to 10% of infrared energy powder of the total weight, compared to about 0.5% contained by the fibers made by the previous conventional methods. The content of the infrared energy powder will vary with the thickness of the fiber as better explained below.

The Term "Fiber Articles" in relation with the present invention is defined as to mean wide concept including garments such as clothes, underwear and socks; fabric apparel accessories such as handkerchiefs and towels; bedding such as quilts and blankets; and wrapping articles.

The present invention generally has three steps in making the synthetic fiber containing the infrared energy powder. The first step is mixing a predetermined quantity of the synthetic material with a predetermined quantity of the infrared energy powder to form a mixture of the synthetic material and the infrared energy powder.

The synthetic material which may be used in this invention may be any variety of polyester. The inventor found that an ideal polyester to be used in this invention to have the melting point of about 219° C. with the density of 1.25 g/cm$^3$ (0.044 oz/0.061 in$^3$).

The infrared energy powder that may be used in this invention may be any material that radiates infrared energy radiation. Examples of possible infrared energy materials may be beside alumina ($Al_2O_3$), silicon dioxide ($SiO_2$), titanium oxide ($TiO_2$), zirconia ($ZrO_2$), ferrite ($FeO_2$, or $Fe_3O_4$), spinel ($MgO.Al2O_3$), magnesia (MgO), celium dioxide ($CeO_2$), barium oxide (Bao), boron carbide ($B_4C$), silicon carbide (SiC), titanium carbide (TiC), molybednum carbide (MoC), tungsten carbide (WC), boron nitride (BN), aluminum nitride (AlN), silicon nitride ($Si_3N_4$), zirconium nitride (ZrN), carbon (C), tungsten (W), molybednum (MO), vanadium (V), platinum (Pt), tantalum (Ta), manganese (Mn), nickel (Ni), copper oxide ($Cu_2O$), and ferrous oxide ($Fe_2O_3$). The possible materials are not limited to the list above, and may range from oxide ceramic materials, non-oxide ceramic materials, non-metal, metals, alloys, crystalline salts, and even rock crystals may be used.

The inventor found the most ideal combination for the use for this invention is as follows. About 72.5% of by weight of the total infrared energy powder is comprised of beside alumina ($Al_2O_3$), about 18.5% by weight is comprised of silicon dioxide ($SiO_2$), about 5.5% by weight is comprised of titanium oxide ($TiO_2$), and about 3.5% of zirconia ($ZrO_2$). The preferred size of the each infrared energy powder grain is about 0.5 mm.

A predetermined quantity of the synthetic material and a predetermined quantity of the infrared energy powder should be mixed together to form a mixture of this synthetic material and the infrared energy powder. In this mixture of this synthetic material and the infrared energy powder, it is recommended that about 95% to about 99% of the mixture by weight is comprised of the synthetic material and about 5% to about 1% of the mixture by weight is comprised of the infrared energy powder. The proportional percentage of the synthetic material and the infrared energy powder should vary according to the thickness of the fiber that is drawn.

In fact, the proportion of the infrared energy powder may vary from about 10% to about less than 1% of the mixture by weight depending upon the thickness of the fiber that is drawn at the end of the process. Without limiting the scope of the invention, as examples, the following infrared energy powder contents have been achieved. The infrared energy powder content of about 1% when the thickness of the final fiber is 1.5 Denier, about 2% when the thickness of the final fiber is about 3 Denier, about 3% when the thickness of the final fiber is about 6 Denier, about 5% when the thickness of the final fiber is about 10 Denier, and about 10% when the thickness of the final fiber is about 20 Denier in size. Each of the proportionate percentage is based on the weight. The inventor believes even greater then 10% infrared energy powder content may be achieved at a fiber thickness that is more than 20 Denier.

The inventor found the highest efficiency in the operation and in the method is obtained when the predetermined quantity of the synthetic material is about 97% of the mixture by weight and the predetermined quantity of the infrared energy powder is about 3% of the mixture by weight.

The second step is adding a predetermined quantity of silicone oil into the mixture of the synthetic material and the infrared energy powder to form a blend of ready to draw substance. The silicone oil should be selected so that the chosen silicone oil can withstand 350° C. or higher temperatures. It is believed by the inventor that the use of the silicone oil not only blends the mixture of the infrared energy powder and the synthetic material together and acts as an epoxy to add strength to the final fiber product, but also acts as a lubricant to mix the synthetic material and the infrared energy powder thoroughly and to reduce friction during the drawing step to make the fiber strand smooth and uniform.

The preferred amount of the predetermined quantity of the silicon oil is about 1% of the mixture by weight, wherein the weight of the mixture used to calculate the quantity of the silicone oil is measured before the silicone oil is added to the mixture. It is believed that this innovative use of the silicone oil as the lubricant and as the epoxy holds together better the infrared energy powder and the synthetic material in the finished product compared with other conventional methods.

The third step is to draw one or more strands of the synthetic fiber containing the infrared energy powder from the blend of ready to draw substance. As explained earlier, because the silicone oil is used, the strands of the synthetic fiber containing the infrared energy powder is smooth and uniform.

It is believed that the use of the silicone oil blends the mixture of the infrared energy powder and the synthetic material together and acts as an epoxy to add strength to the final fiber product. The inventor believes that the most ideal end product, the final fiber, may be obtained when the method of making the synthetic fiber containing the infrared energy powder comprises the steps of mixing the amount of the synthetic material of about 97% of the mixture by weight and the amount of the infrared energy powder of about 3% of the mixture by weight, and blending in about 1% of the mixture by weight of the silicone oil.

An improvement in the final fiber product may be obtained by using the spherical shaped infrared energy powder. The use of the spherical shape infrared energy powder helps preventing the damages to the equipment which are used to mix and draw the synthetic fiber. Some prior art relies on, and sometimes prefers, the use of the needle-shaped, cubicle-shaped, or flat disc shaped infrared energy powder, but their use often results in damaging the interior of the mixer and the equipment; especially around the interfaces, screws, bolts, and nodules.

An innovative improvement may be added to the invention by taking the mixture of the infrared energy powder, the synthetic material, and the silicone oil (the blend of ready to draw substance) and extruding the blend of ready to draw substance into a plurality of pellet size cylinders. The reason for this additional step is maybe because if the ready to draw substance is cut to very small pellet size cylinders, then the material of the ready to draw substance is more manageable and the rate of the production is increased. The inventor believes that the most ideal size of each pellet size cylinder is about 3 mm (1 3/16") diameter circular base with the height of the cylinder about 4 mm (1 9/16").

A new and innovative improvement to the invention may be made by adding a quantity of a silver component along with a mixture of the synthetic material and the infrared energy powder. The blending of the predetermined quantity of the silver component into the mixture of the synthetic material and the infrared energy powder should be done before adding the silicone oil into the mixture.

The silver component of the invention may be elemental silver or a silver salt. Suitable silver salts include silver acetate, silver benzoate, silver carbonate, silver iodate, silver iodite, silver lactate, silver laurate, silver nitrate, silver dioxide, silver palmitate, silver protein and silver sulfadiaziane. The preferred compound for use as the silver component is silver sulfadiaziane (AgSD).

The silver component is added into the mixture to provide the antibiotic effects to the final fiber drawn using this method. The effects of the silver sulfadiaziane and one or more combination of silver salts or silver components are well described and documented in U.S. Pat. No. 3,761,590, incorporated herein by reference.

The amount of the silver component may be any amount, but the inventor found that about 0.2% by total weight to be the most ideal in providing the best final fiber product without weakening the strength of the fibers.

The inventor found that the following to be the most ideal condition in using this invention. Measure about 99 kilograms (218 lbs) of the polyester granules and about 3 kilograms (6.6 lbs) of the infrared energy powder. The infrared energy powder should comprise of about 72.5% by weight of beside alumina ($Al_2O_3$), about 18.5% of silicon dioxide ($SiO_2$), about 5.5% of titanium oxide ($TiO_2$), and about 3.5% of zirconia ($ZrO_2$), and should be spherical in shape. Then, measure about 0.2 kilograms (0.44 lbs) of the silver component and measure about 1 kilogram (2.215 lbs) of the silicone oil and mix all of the polyester granules, infrared energy powder, the silver component, and the silicone oil together.

This mixture of all the materials aforementioned should be mixed in a large mixer which is tightly shut at about 700 rpm for approximately 10 minutes. The inventor found that about 10 minutes is an ideal duration to mix because if the mixing time is less than ten minutes for this combination of materials, then polyester granules and infrared energy powder are not fused together well, and if the mixing duration exceeds ten minutes, then the heat generated inside the mixer will dehydrate the mixture so that the mixed product is too brittle and weak.

After about ten minutes of mixing, remove the material from the mixer and put it in a pressure hopper. The internal temperature of the hopper should be set between 200° C. and 280° C. Use the hopper to extrude the blend of ready to draw substance into a plurality of pellet size cylinders. It is expected the pellets first out of the hopper are generally too brittle and are not the best to be used for the next step thus they should be collected and reused later.

After collecting all the right pellets, measure the humidity of the pellets so that pellets with more than 0.1% humidity are removed and pellets with less than 0.1% humidity are collected and sent to the final drawing hopper (sometimes known as a nodule hopper or a strand drawing machine). Now, the collected pellets are drawn out to be one or more strands of the synthetic fiber containing the infrared energy powder. The strands of the synthetic fiber containing the infrared energy powder should be wounded on bobbins.

One of the most important aspects of this invention is that the process is quite simple and the final product has a higher tensile strength than that of the conventional fiber containing the infrared energy powder or other ceramics. Because of the strength of the fiber, the fibers can be used in a variety of fabric. Moreover, because the final product from this invention contains much more infrared energy powder than the fibers which are made from prior inventions, the useful infrared slight energy radiation is that much stronger and is maintained throughout the life of the fabric. Furthermore, when the silver component is added to the mixture of the infrared energy powder and the synthetic fiber, the final product then contains antibacterial effect without loosing the integrity of the fiber strength. Therefore, it is believed that the fabric which is fabricated using this invention is great for many purposes including, and not limited to, keeping a person warm in a cold environment without the bulkiness, and fermenting various food in a clean environment. The fabric may also be ideal for a patient to be kept warm in a hospital or a sanitary environment.

Although the present invention has been described in considerable detail with reference to certain preferred versions thereof, other versions are possible. As an example, a dye may be mixed along with the synthetic material and the infrared energy powder to modify the color of the strands of the synthetic fiber containing the infrared energy powder. Therefore, the spirit and the scope of the appended claims should not be limited to the description of the preferred embodiment or the preferred versions contained therein.

What I claim is:

1. A method of making a synthetic fiber containing the infrared energy powder, which comprises the steps of:

a) mixing a predetermined quantity of a synthetic material with a predetermined quantity of the infrared energy powder to form a mixture of the synthetic material and the infrared energy powder;

b) adding a predetermined quantity of silicone oil into the mixture of the synthetic material and the infrared energy powder to form a blend of ready to draw substance; and c) drawing one or more strands of synthetic fiber containing the infrared energy powder from the blend of ready to draw substance.

2. A method of making a synthetic fiber containing the infrared energy powder of claim 1 wherein the predetermined quantity of the synthetic material is about 95 to about 99 percent of the mixture by weight and the predetermined quantity of the infrared energy powder is about 5 to about 1 percent of the mixture by weight.

3. A method of making a synthetic fiber containing the infrared energy powder of claim 2 wherein the predetermined quantity of the synthetic material is about 97 to about 99 percent of the mixture by weight and the predetermined quantity of the infrared energy powder is about 3 to about 1 percent of the mixture by weight.

4. A method of making a synthetic fiber containing the infrared energy powder of claim 3 wherein the predetermined quantity of the synthetic material is about 97 to about 98 percent of the mixture by weight and the predetermined quantity of the infrared energy powder is about 3 to about 2 percent of the mixture by weight.

5. A method of making a synthetic fiber containing the infrared energy powder of claim 4 wherein the predetermined quantity of the synthetic material is about 97 percent of the mixture by weight and the predetermined quantity of the infrared energy powder is about 3 percent of the mixture by weight.

6. A method of making a synthetic fiber containing the infrared energy powder of claim 5 wherein the predetermined quantity of the synthetic material is about 97 kilogram by weight, and the predetermined quantity of the infrared energy powder is about 3 kilogram by weight.

7. A method of making a synthetic fiber containing the infrared energy powder of claim 3 wherein the predetermined quantity of the silicone oil is about 1 percent of the mixture by weight, wherein the weight of the mixture used to calculate the predetermined quantity of the silicone oil is measured before the silicone oil is added to the mixture.

8. A method of making a synthetic fiber containing the infrared energy powder of claim 5 wherein the predetermined quantity of the silicone oil is about 1 percent of the mixture by weight, wherein the weight of the mixture used to calculate the predetermined quantity of the silicone oil is measured before the silicone oil is added to the mixture.

9. A method of making a synthetic fiber containing the infrared energy powder of claim 6 wherein the predetermined quantity of the silicone oil is about 1 kilogram by weight.

10. A method of making a synthetic fiber containing the infrared energy powder of claim 1 wherein the infrared energy powder is spherical in shape.

11. A method of making a synthetic fiber containing the infrared energy powder of claim 7 wherein the infrared energy powder is spherical in shape.

12. A method of making a synthetic fiber containing the infrared energy powder of claim 1 further comprises a step of blending a predetermined quantity of a silver component into the mixture.

13. A method of making a synthetic fiber containing the infrared energy powder of claim 3 further comprises a step of blending a predetermined quantity of the silver component into the mixture wherein the predetermined quantity of the silver component is about 0.2 percent of the mixture by weight, wherein the weight of the mixture used to calculate the predetermined quantity of the silver component is measured before the silicone oil or the silver component is added to the mixture.

14. A method of making a synthetic fiber containing the infrared energy powder of claim 6 further comprises a step of blending a predetermined quantity of the silver component into the mixture wherein the predetermined quantity of the silver component is about 0.2 kilogram by weight.

15. A method of making a synthetic fiber containing the infrared energy powder, which comprises the steps of:

a) mixing a predetermined quantity of the synthetic material with a predetermined quantity of the infrared energy powder to form a mixture of the synthetic material and the infrared energy powder, wherein the predetermined quantity of the synthetic material is about 97 to about 99 percent of the mixture by weight and the predetermined quantity of the infrared energy powder is about 3 to about 1 percent of the mixture by weight;

b) blending a predetermined quantity of a silver component into the mixture wherein the predetermined quantity of the silver component is about 0.2 percent of the mixture by weight, wherein the weight of the mixture used to calculate the predetermined quantity of the silver component is measured before the silver component is added to the mixture;

c) adding a predetermined quantity of silicone oil into the mixture of the synthetic material and the infrared energy powder to form a blend of ready to draw substance, wherein the predetermined quantity of the silicone oil is about 1 percent of the mixture by weight before the silicone oil is added to the mixture; and d) drawing one or more strands of synthetic fiber containing the infrared energy powder from the blend of ready to draw substance.

16. A method of making a synthetic fiber containing the infrared energy powder of claim 15 wherein the predetermined quantity of the synthetic material is about 97 kilogram by weight, the predetermined quantity of the infrared energy powder is about 3 kilogram by weight, the predetermined quantity of the silicone oil is about 1 kilogram by weight, and the predetermined quantity of the silver component is about 0.2 kilogram by weight.

17. A method of making a synthetic fiber containing the infrared energy powder, which comprises the steps of:

a) mixing a predetermined quantity of the synthetic material with a predetermined quantity of the infrared energy powder to form a mixture of the synthetic material and the infrared energy powder, wherein the predetermined quantity of the synthetic material is about 97 to about 99 percent of the mixture by weight and the predetermined quantity of the infrared energy powder is about 3 to about 1 percent of the mixture by weight;

b) blending a predetermined quantity of a silver component into the mixture wherein the predetermined quantity of the silver component is about 0.2 percent of the mixture by weight, wherein the weight of the mixture used to calculate the predetermined quantity of the silver component is measured before the silver component is added to the mixture;

c) adding a predetermined quantity of silicone oil into the mixture of the synthetic material and the infrared energy powder to form a blend of ready to draw substance, wherein the predetermined quantity of the silicone oil is about 1 percent of the mixture by weight before the silicone oil is added to the mixture;

d) extruding the blend of ready to draw substance into a plurality of pellet size cylinders; and e) drawing one or more strands of the synthetic fiber containing the infrared energy powder from the plurality of pellet size cylinders of the blend of ready to draw substance.

18. A method of making a synthetic fiber containing the infrared energy powder of claim 17 wherein the predetermined quantity of the synthetic material is about 97 kilogram by weight, the predetermined quantity of the infrared energy powder is about 3 kilogram by weight, the predetermined quantity of the silicone oil is about 1 kilogram by weight, and the predetermined quantity of the silver component is about 0.2 kilogram by weight.

* * * * *